United States Patent [19]

Colvin et al.

[11] Patent Number: 4,842,822

[45] Date of Patent: Jun. 27, 1989

[54] ALUMINUM-LITHIUM ALLOY AND METHOD OF INVESTMENT CASTING AN ALUMINUM-LITHIUM ALLOY

[75] Inventors: Gregory N. Colvin, Charlottesville, Va.; Stewart J. Veeck, North Muskegon, Mich.

[73] Assignee: Howmet Corporation, Greenwhich, Conn.

[21] Appl. No.: 943,434

[22] Filed: Dec. 19, 1986

[51] Int. Cl.[4] ..... C22C 21/00

[52] U.S. Cl. ..... 420/533; 148/3; 148/159; 148/417; 420/535

[58] Field of Search ..... 420/533, 534, 535; 148/3, 159, 417, 439

[56] References Cited

U.S. PATENT DOCUMENTS

| | | |
|---|---|---|
| 2,188,203 | 1/1940 | Mansfield . |
| 2,357,449 | 9/1944 | Bonsack . |
| 4,094,705 | 6/1978 | Sperry et al. . |
| 4,164,434 | 8/1979 | Fister, Jr. et al. . |

OTHER PUBLICATIONS

E. S. Balmuth and R. Schmidt, "A Perspective on the Development of Aluminum–Lithium Alloys," Aluminum–Lithium Alloys, AIME, 1981, pp. 70–84.

T. H. Sanders, Jr. and E. A. Starke, Jr., "Aluminum–Lithium Alloys: New Materials for Tomorrow's Technology," Rapid Solidification Technology: Source Book, American Society for Metals, Metals Park, Ohio, 1983, pp. 396–402.

A. P. Divecha and S. D. Karmarkar, "The Search for Al–Li Alloys," Advanced Materials and Processes Inc. Metal Progress, Oct., 1986, pp. 74–79.

*Primary Examiner*—R. Dean

*Attorney, Agent, or Firm*—Finnegan, Henderson, Farabow, Garrett & Dunner

[57] ABSTRACT

Aluminum-lithium alloy and method of investment casting an aluminum-lithium alloy including the steps of providing an aluminum-lithium alloy melt having a composition consisting essentially of about 2.0 to about 2.8 w/o lithium, about 1.2 to about 1.8 w/o copper provided that the combined lithium and copper content does not exceed 4.0 w/o, about 0.8 to about 1.0 w/o magnesium, the balance essentially aluminum, adding an effective amount of a grain refining agent to the aluminum-lithium alloy melt investment casting the melt, solution heat treating the aluminum-lithium alloy investment casting for up to 30 hours at continuously increasing temperatures to within approximately 30° to 40° F. of the solidus temperature of said aluminum-lithium alloy, and aging the aluminum-lithium alloy investment casting at a temperature and for a time sufficient to optimize the δ′ precipitate size.

14 Claims, 3 Drawing Sheets

ALUMINUM-LITHIUM ALLOY AND METHOD OF INVESTMENT CASTING AN ALUMINUM-LITHIUM ALLOY

FIELD OF INVENTION

The present invention relates to aluminum-lithium alloys and, more particularly, to a method of investment casting an aluminum-lithium alloy composition including aluminum, lithium, copper, magnesium, and titanium as the major alloying elements.

BACKGROUND OF THE INVENTION

Aluminum-lithium alloys, which exhibit reduced density and increased modulus characteristics, offer the potential of both weight savings and increased stiffness over conventional aluminum alloys used for aircraft components. Despite these potential benefits; the use of aluminum-lithium alloys in aircraft structural applications has been limited by their poor ductilities. The low ductilities exhibited by aluminum-lithium alloys have been attributed to the nonhomogeneous precipitation of δ' ($Al_3Li$), an ordered, shearable precipitate which promotes predominantly planar slip and intergranular fracture in these alloys.

In the peak aged condition, most age hardened aluminum alloys have a precipitate free zone (PFZ) along the grain boundaries. The PFZ is softer than the surrounding matrix and accordingly, is more easily deformed than the matrix in the age hardened condition. As a result, local deformation in the PFZ can be severe enough to initiate a crack at a grain boundary or at a grain boundary triple point before any substantial macroscopic deformation occurs. Once a crack has initiated, it may easily propagate along the grain boundaries. This mechanism leads to a microstructure with a low macroscopic ductility; however, other microstructural factors such as grain size, secondary dendrite arm spacing (SDAS), and elemental segregation may also influence the fracture characteristics of these alloys.

Due to the low ductility associated with coarse grain, cast microstructures, recent developmental efforts concerning aluminum-lithium alloys have been directed toward the production of homogenous, fine grain, wrought microstructures via rolling or forging of IM or PM billets. These activities have led to the introduction of several commercial wrought alloys including: Al-2.2 w/o Li-2.7 w/o Cu-0.12 w/o Zr; Al-2.2 w/o Li-1.1 w/o Cu-0.7 w/o Mg-0.8 w/o Zr; Al-1.7 w/o Li-1.8 w/o Cu-1.1 w/o Mg-0.04 w/o Zr; Al-1.9 w/o Li-2.5 w/o Cu-0.2 w/o Mg-0.04 w/o Zr; Al-2.3 w/o Li-1.25 w/o Cu-0.89 w/o Mg-0.13 w/o Zr; and Al-2.4 w/o Li-1.6 w/o Cu-0.5 w/o Mg-0.16 w/o Zr. One of the key features of these wrought alloys is the addition of zirconium to limit grain growth during thermomechanical processing which yields superior tensile strength and ductility properties. Additionally, strain age processing has been used successfully to promote secondary precipitation in PFZ regions and further enhance mechanical properties. Attempts to cast these wrought alloys using conventional investment casting techniques, however, have revealed that even relatively small amounts of zirconium tend to segregate undesirably which embrittles the castings. Thus, in spite of the excellent properties exhibited by these wrought alloys, they suffer from the disadvantage that they cannot be formed into net shape configurations. Consequently, in complex applications wrought materials are costly to produce because they require extensive machining. Thus, it is apparent that a method of forming net shape components from aluminum-lithium alloys would be desirable.

Accordingly, it is an object of the invention to provide a method of investment casting aluminum-lithium alloys to produce net shape components exhibiting the low density, high modulus characteristics of wrought materials, as well as suitable strength and ductility properties.

Another object of the invention is to provide an aluminum-lithium alloy composition for investment casting which exhibits a combination of strength, ductility, and density properties comparable to those of conventional cast aluminum alloys such as A356 and A357.

Additional objects and advantages will be set forth in part in the description which follows, and in part, will be obvious from the description, or maybe learned by practice of the invention.

SUMMARY OF THE INVENTION

To achieve the foregoing objects in accordance with the purpose of the invention, as embodied and broadly described herein, the method of casting an aluminum-lithium alloy of the present invention includes the steps of providing an aluminum-lithium alloy melt having a composition consisting essentially of about 2.0 to about 2.8 w/o lithium, about 1.2 to about 1.8 w/o copper provided that the combined lithium and copper content does not exceed 4.0 w/o, about 0.8 to about 1.1 w/o magnesium, and the balance essentially aluminum, adding an effective amount of a grain refining agent to the aluminum-lithium alloy melt, investment casting the aluminum-lithium alloy melt, solution heat treating the aluminum-lithium alloy investment casting for up to about 30 hours at continuously increasing temperatures to within approximately 30° to 40° F. of the solidus temperature of the aluminum-lithium alloy, and aging said aluminum-lithium alloy investment casting for a time sufficient to optimize the δ' precipitate size. Preferably, the aluminum-lithium alloy of the present invention includes about 2.4 w/o lithium, about 1.5 w/o copper, about 1.0 w/o magnesium, about 0.3 w/o titanium, and the balance essentially aluminum.

DESCRIPTION OF THE PREFERRED EMBODIMENTS

Reference will now be made in detail to the present preferred embodiments of the invention.

The present invention resulted from an investigation of the optimal compositional limits for an aluminum-lithium investment casting alloy. Because castings are prone to segregation, the compositional requirements are different than for situations where thermomechanical processing is used to achieve microstructural homogenization. For example, lithium and copper additions are needed to provide precipitation strengthening through the formation of soluble δ' ($Al_3Li$), θ' ($Al_2Cu$) and $T_1$ ($Al_2CuLi$) phases. Magnesium additions provide solid solution strengthening and reduce the solubility of the δ' phase which increases the volume content of δ' precipitate. It has been discovered that cast Al-Li-Cu-Mg alloys having high lithium and copper contents form an insoluble $T_2$ phase ($Al_6CuLi_3$) which, through the formation of continuous brittle interdedritic networks, can have a deleterious affect on the mechanical behavior of these alloys.

It has been determined that, after solution heat treatment, residual, undissolved amounts of this $T_2$ phase greater than approximately 2 v/o (volume percent) can cause reductions in the maximum achievable ductility in the cast form of these alloys. This range of $T_2$ phase content corresponds to a total Li-Cu content of less than or equal to 4.0 w/o. With respect to the addition of magnesium, it has been found that the optimal amount of magnesium is within the range of 0.8 to 1.1 w/o. The upper limit of 1.1 w/o Mg is defined by the maximum solubility of magnesium in aluminum, whereas the lower limit of 0.8 w/o Mg corresponds to the level below which the beneficial effect of magnesium in increasing the δ' precipitation is rapidly lost.

Figure 4:
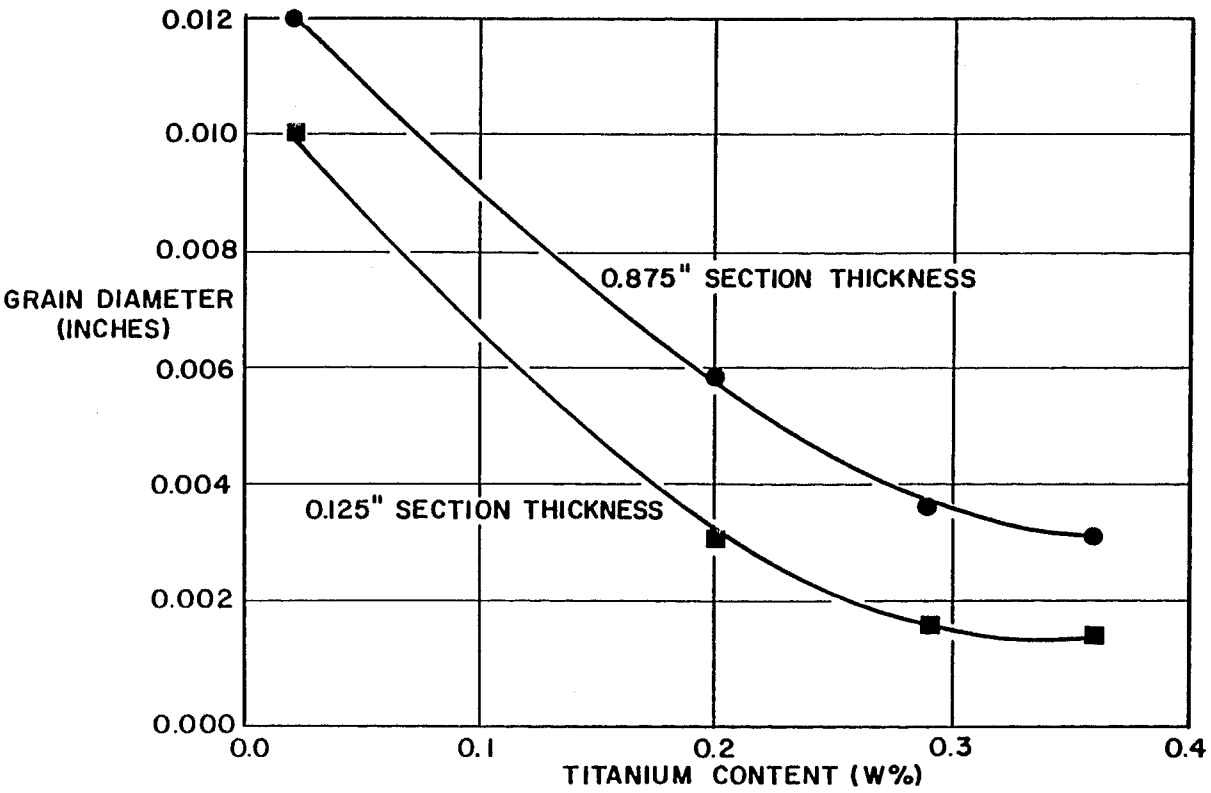
FIG. 4 is a graph of grain size vs. titanium content in an as-cast Al - 2.3 w/o Li - 1.5 w/o Cu - 1.0 w/o Mg alloy.

To reduce the grain size of the investment cast aluminum-lithium alloy, a rain refining agent is added to the melt. In a preferred embodiment of the present invention, a grain refining agent including titanium such as, but not limited to, Al-Ti-B is added to the melt. FIG. 4 shows the dramatic reduction in grain size at relatively high Al-Ti-B levels. The reduced grain size yields improvements in both ultimate tensile strength and elongation.

To produce useful investment cast aluminum-lithium alloys, the inclusion of several other elements must be controlled. Iron and silicon, which form insoluble intermetallics at interdendritic locations, should be maintained at levels of less than or equal to 0.1 w/o and 0.05 w/o, respectively. Potassium and sodium, which segregate directly to grain boundaries and form thin low-strength films, should be maintained at levels of less than or equal to 0.005 w/o to avoid any potential problems with ductility loss.

Thus, in accordance with the invention, the optimal compositional ranges for the casting of aluminum-lithium alloys are 2.0 to 2.8 w/o Li, 1.2 to 1.8 w/o Cu, 0.8 to 1.1 w/o Mg, less than about 0.1 w/o iron, less than about 0.05 w/o silicon, less than about 0.005 w/o potassium, less than 0.005 w/o sodium, and the balance essentially aluminum.

In accordance with the invention, a melt of the aluminum-lithium alloy within the optimal compositional ranges for casting described above is provided. An effective amount of a grain refining agent is then added to the melt. In connection with the description of the present invention, "an effective amount" of a grain refining agent is defined as an amount sufficient to yield a grain size in the investment cast aluminum-lithium alloy of no more than 0.005 inches (ASTM 3). This definition further requires that the presence of the grain refining agent not have any detrimental effect on the properties of the investment cast alloy which, for example, may be caused by segregation in the casting. In a preferred embodiment, a grain refining agent including titanium such as, but not limited to, Al-Ti-B is added to the melt to bring the level of titanium in the alloy to about 0.1 to about 1.0 w/o.

Subsequently, the melt is cast using investment casting procedures which, due to the reactive nature of aluminum-lithium alloys, should be particularly suited to the casting of such alloys. The investment casting procedures used in the practice of the invention are known to those in the art and include preparing a ceramic investment mold with a nonreactive facecoat using the well-known lost wax process, removing the wax by melting, firing the dewaxed mold at an appropriate temperature to produce adequate shell strength, and pouring molten metal into the preheated mold cavity in an inert environment. To improve the integrity of the casting by eliminating any residual casting shrinkage, the aluminum-lithium alloy casting may be subjected to a postcasting hot isostatic pressing treatment.

Figure 1:
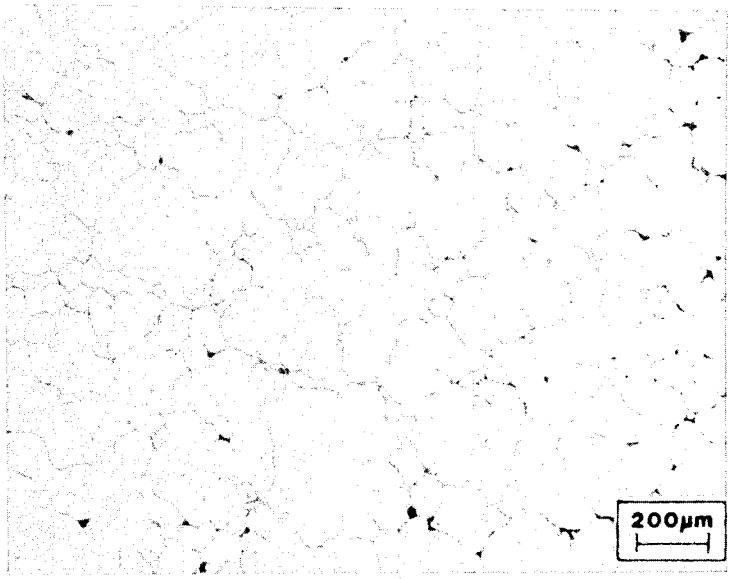
FIG. 1 is a 50× photomicrograph showing the distribution of secondary phases in the as-cast microstructure of Al - 2.3 w/o Li - 1.5 w/o Cu - 1.0 w/o Mg - 0.2 w/o Ti.
Figure 2:
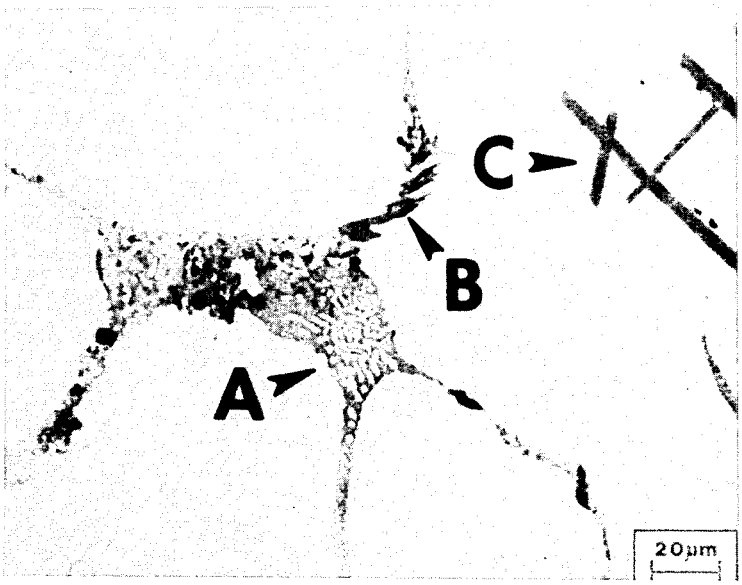
FIG. 2 is a 500× photomicrograph showing the as-cast microstructure in the aluminum-lithium alloy depicted in FIG. 1.

The as-cast microstructure for Al - 2.3 w/o Li - 1.5 w/o Cu - 1.0 w/o Mg - 0.2 w/o Ti is shown in FIGS. 1 and 2. FIG. 1 shows the distribution of secondary phases. FIG. 2 shows the as-cast microstructure. In FIG. 2, eutectic ternary phases $T_1$ and $T_2$ are denoted by the arrow labeled A, $(Fe,Cu)Al_3$ phases are denoted by the arrow labeled B, and $TiAl_3$ phases are denoted by the arrow labeled C. As can be seen in FIG. 2, the as-cast microstructure consists predominantly of the ternary eutectic phases $T_1$ and $T_2$ at interdendritic locations, with occasional needle-like projections comprised of $(Fe,Cu)Al_3$ intermetallic phases. Rectangular or rod-like $TiAl_3$ phases (grain nucleants) can be observed randomly throughout the microstructure.

Next, the aluminum-lithium alloy casting is solution heat treated for up to about 30 hours under an inert environment to temperatures within approximately 30° to 40° F. of the solidus temperature of the alloy. The temperature increase may be step-wise or a programmed continuous increase. Preferably, the casting is heated at 950° F. for approximately 5 hours, gradually heated up to 1000° F. over the course of 1–2 hours, and held at that temperature for approximately 24 hours. The solution heat treatment is necessary to achieve complete homogenization and solutioning of the coarse interdendritic networks present in the as-cast microstructure as is shown in FIG. 1 and, more particularly, in FIG. 2.

After solution heat treating, the aluminum-lithium alloy casting is subjected to an aging treatment. The aging treatment time must be limited to produce an essentially underaged condition. This is necessary to achieve a useful combination of strength and ductility and to prevent excessive softening in the PFZ regions. In accordance with the invention, the aging treatment is at a temperature and for time sufficient to optimize the δ' precipitate size. Preferably, the aging treatment is at 375° F. for 2–4 hours.

The δ' precipitate size associated with the optimal aging cycle appears to be within the range of 150–400 Å as determined by transmission electron microscopy (TEM).

Figure 3:
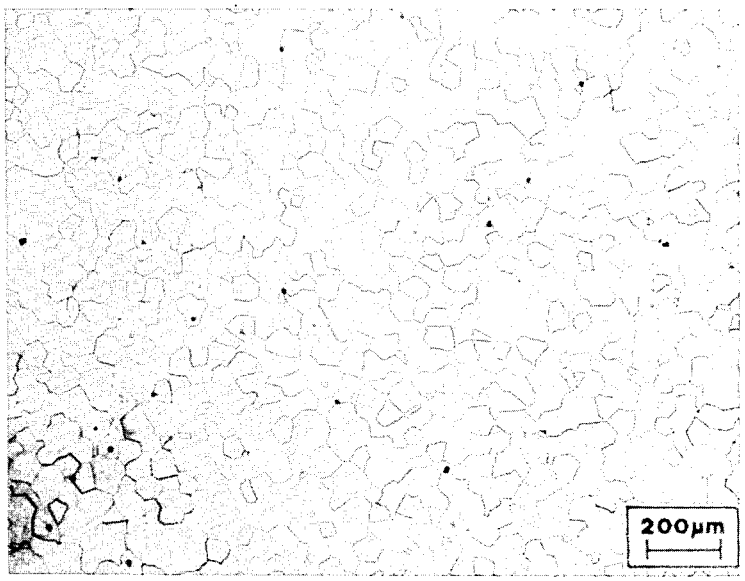
FIG. 3 is a 50× photomicrograph showing the microstructure of the aluminum-lithium alloy depicted in FIG. 1 after solutioning and aging heat treatments.

FIG. 3 shows the microstructure of the aluminum-lithium alloy shown in FIGS. 1 and 2 after the solutioning and aging heat treatments. As can be seen in FIG. 3, the microstructure is comprised of small amounts (less than about 2 v/o (volume percent)) of residual $(Fe,Cu)Al_3$ and $T_2$ phases (insoluble) at intergranular locations. The $TiAl_3$ (grain nucleant) phase can be observed randomly throughout the microstructure, predominantly at intragranular locations. The $T_1$ phase has been substantially completely solutioned and reprecipitated. The δ' and $T_1$ phases (not shown in FIG. 3 but visible using transmission electron microscopy (TEM)) provide precipitation strengthening in the aluminum-lithium alloy.

The present invention will be more readily understood from a consideration of the following detailed example.

EXAMPLE 1

Using conventional investment casting procedures, an experimental Al-2.3 w/o Li-1.5 w/o Cu-1.0 w/o Mg-0.2 w/o Ti alloy was cast into the shape of a vane actuating arm. Following hot isostatic pressing at 950° F. and 15 ksi for 3 hours, the individual components were solution heat treated in argon using a step cycle consisting of 950° F. for 5 hours and then 1000° F. for the remainder of 24 hours. After the solution heat treatment, the ASTM grain size was determined to be ASTM 5 (0.0025 inches). Subsequently, tensile specimens were machined from the cast components. After machining, the tensile specimens were aged at 375° F. for 4 hours to optimize the δ' precipitate size. Next, the tensile specimens were tested at 70° F.. The results of the tensile evaluations, which are shown in Table I below, indicated tensile properties comparable to those required for A356 and A357. Moreover, based on density reductions of approximately 5.2% and modulus improvement of approximately 10.6% relative to A357, the resulting improvements in specific strengths and modulus were in the range of 15 to 20%.

TABLE I

70° F. TENSILE DATA FOR CAST VANE ACTUATING ARMS AFTER SOLUTIONING AND AGING HEAT TREATMENTS

| Casting No. | Average Composition (in w/o) | Vane Component No. | UTS (KSI) | 0.2% YS (KSI) | Elongation (%) |
|---|---|---|---|---|---|
| | Al—2.19 Li—1.7 Cu—1.06 Mg 0.2 Ti | 1 | 50.0 | 40.3 | 6.0 |
| | | | 54.8 | 41.6 | 5.4 |
| | | 3 | 51.0 | 39.1 | 3.2 |
| | | | 49.2 | 42.1 | 4.0 |
| | | | 58.0 | 40.8 | 7.4 |
| | | | 56.7 | 39.8 | 5.0 |
| | | 6 | 54.5 | 41.4 | 6.0 |
| | | | 55.8 | 41.9 | 5.0 |
| | | | 56.7 | 41.2 | 6.9 |
| | | | 54.7 | 39.5 | 3.9 |
| | Al—2.28 Li—1.75 Cu—1.07 Mg—0.2 Ti | 1 | 52.6 | 39.8 | 3.6 |
| | | | 55.6 | 40.3 | 6.6 |
| | | | 59.0 | 38.2 | 5.6 |
| | | | 54.2 | 44.7 | 4.6 |
| | | 3 | 54.0 | 40.8 | 4.4 |
| | | | 56.5 | 40.2 | 6.8 |
| | | | 51.8 | 34.9 | 2.1 |
| | | 6 | 57.5 | 41.3 | 6.2 |
| | | | 50.3 | 40.2 | 4.8 |
| | | | 56.3 | 35.5 | 6.0 |
| Average Tensile Properties | | | 54.5 | 40.2 | 5.2 |
| Minimum A357 Tensile Requirements | | | 50.0 | 40.0 | 3.0 |

It would be apparent to those skilled in the art that various modifications and variations can be made in the method of investment casting an aluminum-lithium alloy and the aluminum-lithium alloy of the present invention without departing from the scope of the invention as defined by the appended claims and their equivalents.

What is claimed is:

1. An investment cast and aged aluminum-lithium alloy consisting essentially of about 2.0 to about 2.8 w/o lithium, about 1.2 to about 1.8 w/o copper, the combined lithium and copper content being 4.0 w/o or less, about 0.8 to about 1.1 w/o magnesium, an effective amount of a grain refining agent, and the balance essentially aluminum.

2. An investment cast and aged aluminum-lithium alloy consisting essentially of about 2.0 to about 2.8 w/o lithium, about 1.2 to about 1.8 w/o copper, the combined lithium and copper content being 4.0 w/o or less, about 0.8 to about 1.1 w/o magnesium, an effective amount of a grain refining agent, and the balance essentially aluminum having an elongation of approximately 5.0% at 70° F.

3. An investment cast and aged aluminum-lithium alloy consisting essentially of about 2.0 to about 2.8 w/o lithium, about 1.2 to about 1.8 w/o copper, the combined lithium and copper being about 4.0 w/o or less, about 0.8 to about 1.1 w/o magnesium, an effective amount of a grain refining agent, and the balance essentially aluminum having a microstructure comprised of small amounts of residual $(Fe,Cu)Al_3$ and $T_2$ phases at intergranular locations and further characterized in that the δ' and $T_1$ phases provide precipitation strengthening.

4. An aluminum-lithium alloy consisting essentially of about 2.0 to about 2.8 w/o lithium, about 1.2 to about 1.8 w/o copper, the combined lithium and copper content being 4.0 w/o or less, about 0.8 to about 1.1 w/o magnesium, about 0.1 to about 1.0 w/o titanium, and the balance essentially aluminum.

5. An aluminum-lithium alloy consisting essentially of about 2.0 to about 2.8 w/o lithium, about 1.2 to about 1.8 w/o copper, the combined lithium and copper content being 4.0 w/o or less, about 0.8 to about 1.1 w/o magnesium, about 0.1 to about 1.0 w/o titanium, less than about 0.10 w/o iron, less than about 0.05 w/o silicon, less than about 0.005 w/o potassium, less than about 0.005 w/o sodium, and the balance essentially aluminum.

6. An aluminum-lithium alloy consisting essentially of about 2.4 w/o lithium, about 1.5 w/o copper, about 1.0 w/o magnesium, about 0.30 w/o titanium, and the balance essentially aluminum.

7. An investment cast and aged aluminum-lithium alloy consisting essentially of about 2.0 to about 2.8 w/o lithium, about 1.2 to about 1.8 w/o copper, the combined lithium and copper content being 4.0 w/o or less, about 0.8 to about 1.1 w/o magnesium, about 0.1 to about 1.0 w/o titanium, and the balance essentially aluminum having an ultimate tensile strength of approximately 50 ksi, a 0.2% yield strength of approximately 40 ksi, and an elongation of approximately 5.0% at 70° F.

8. An investment cast and aged aluminum-lithium alloy consisting essentially of about 2.0 to about 2.8 w/o lithium, about 1.2 to about 1.8 w/o copper, the combined lithium and copper content being 4.0 w/o or less, about 0.8 to about 1.1 w/o magnesium, about 0.1 to about 1.0 w/o titanium, less than about 0.1 w/o iron, less than about 0.05 w/o silicon, less than about 0.005 w/o potassium, less than about 0.005 w/o sodium, and the balance essentially aluminum having an elongation of approximately 5% at 70° F.

9. An investment cast and aged aluminum-lithium alloy consisting essentially of about 2.4 w/o lithium, about 1.5 w/o copper, about 1.0 w/o magnesium, about 0.3 w/o titanium, and the balance essentially aluminum having an ultimate tensile strength of approximately 50 ksi and a 0.2% yield strength of approximately 40 ksi.

10. A method of casting an aluminum-lithium alloy comprising the steps of:

providing an aluminum-lithium alloy melt having a composition consisting essentially of about 2.0 to about 2.8 w/o lithium, about 1.2 to about 1.8 w/o copper, the combined lithium and copper content being 4.0 w/o or less, about 0.8 to about 1.1 w/o magnesium, and the balance essentially aluminum;

adding an effective amount of a grain refining agent to said aluminum-lithium alloy melt;

investment casting said aluminum-lithium alloy melt;

solution heat treating said aluminum-lithium alloy investment casting for up to about 30 hours at continuously increasing temperatures to within approximately 30° to 40° F. of the solidus temperature of said aluminum-lithium alloy; and aging said aluminum-lithium alloy investment casting at a temperature and for a time sufficient to optimize the δ′ precipitate size.

11. A method of casting an aluminum-lithium alloy comprising the steps of:

providing an aluminum-lithium alloy melt having a composition consisting essentially of about 2.0 to about 2.8 w/o lithium, about 1.2 to about 1.8 w/o copper, the combined lithium and copper content being 4.0 w/o or less, about 0.8 to about 1.1 w/o magnesium, and the balance essentially aluminum;

adding a grain refining agent including titanium to said aluminum-lithium alloy melt to bring the level of titanium in said alloy melt to about 0.1 to about 1.0 w/o;

investment casting said aluminum-lithium alloy melt;

solution heat treating said aluminum-lithium alloy investment casting for up to about 30 hours at continuously increasing temperatures to within approximately 30° to 40° F. of the solidus temperature of said aluminum-lithium alloy; and aging said aluminum-lithium alloy investment casting at a temperature and for a time sufficient to optimize the δ′ precipitate size.

12. The method of claim 7, wherein the grain refining agent is Al-Ti-B.

13. An investment cast and aged aluminum-lithium alloy consisting essentially of bout 2.0 to about 2.8 w/o lithium, about 1.2 to about 1.8 w/o copper, the combined lithium and copper being about 4.0 w/o or less, about 0.8 to about 1.1 w/o magnesium, about 0.1 to about 1.0 w/o titanium, and the balance essentially aluminum having a microstructure comprised of small amounts of residual $(Fe,Cu)Al_3$ and $T_2$ phases at intergranular locations and further characterized in that the δ′ and $T_1$ phases provide precipitation strengthening.

14. An investment cast and aged aluminum-lithium alloy consisting essentially of about 2.3 w/o lithium, about 1.5 w/o copper, about 1.0 w/o magnesium, about 0.2 w/o titanium, and the balance essentially aluminum having a microstructure as shown in FIG. 3.

* * * * *